US005716464A

United States Patent [19]

Bano et al.

[11] Patent Number: 5,716,464

[45] Date of Patent: Feb. 10, 1998

[54] PROCESS FOR PRODUCING A STRIP OF HOT ROLLED STEEL SHEET HAVING A VERY HIGH YIELD POINT AND THE STEEL SHEET OBTAINED

[75] Inventors: Xavier Bano, Istres; Maurice Malta, Martigues; Stéphane Fiori, Istres, all of France

[73] Assignee: Sollac, Puteaux, France

[21] Appl. No.: 663,529

[22] Filed: Jun. 13, 1996

[30] Foreign Application Priority Data

Jun. 15, 1995 [FR] France ..... 95 07122

[51] Int. Cl.[6] ..... C22C 38/12; C22C 38/14; C21D 7/13

[52] U.S. Cl. ..... 148/320; 148/654; 420/124

[58] Field of Search ..... 148/654, 320; 420/124

[56] References Cited

U.S. PATENT DOCUMENTS 3,976,514 8/1976 Matsukura et al. .

FOREIGN PATENT DOCUMENTS 0 535 238 4/1993 European Pat. Off. .
2 133 952 12/1972 France .
25 17 164 10/1976 Germany .
62-20821 1/1987 Japan ..... 148/320
4193908 7/1992 Japan ..... 148/654
WO 95/26424 10/1995 WIPO .

*Primary Examiner*—Deborah Yee
*Attorney, Agent, or Firm*—Oblon, Spivak, McClelland, Maier & Neustadt, P.C.

[57] ABSTRACT

Process for producing a strip of hot rolled steel sheet having a very high yield point of use in particular for the forming of parts and having a brittle/ductile transition at a temperature below −50° C., characterized in that the steel having the following composition by weight;

carbon≦0.1%,
1%≦manganese≦1.5%,
silicon≦0.3%,
phosphorus≦0.03%,
sulphur≦0.01%,
0.01%≦aluminium≦0.1%,
0.04%≦niobium≦0.06%,
0.1%≦titanium≦0.15%,
0.1%≦molybdenum≦0.2%, is subjected, after hot rolling, to a controlled cooling at a cooling rate of between 20° C. per second and 100° C. per second down to a temperature of between 550° C. and 750° C. of the end of the cooling. The invention also relates to the sheet obtained.

12 Claims, 2 Drawing Sheets

PROCESS FOR PRODUCING A STRIP OF HOT ROLLED STEEL SHEET HAVING A VERY HIGH YIELD POINT AND THE STEEL SHEET OBTAINED

FIELD OF THE INVENTION

The invention relates to a process for producing a strip of hot rolled steel sheet having a very high yield point of use in particular for the forming of parts and having a brittle/ductile transition at a temperature below −50° C.

BACKGROUND OF THE INVENTION

In the field of the production of hot rolled sheets of steel whose characteristics are obtained by a controlled rolling, products are known in a range of steels having a high yield point, i.e. between 315 MPa and 700 MPa.

The controlled rolling permits maintaining in the steel of the sheet a low equivalent carbon content and obtaining desired mechanical properties by a refining of the ferritic structure grain and a coherent precipitation of niobium carbonitride, the niobium being if desired associated with titanium or vanadium.

For example, a product such as a sheet of ULCV steel (low carbon bainitic structure) has a yield point which may be higher than 700 MPa and a brittle/ductile transition temperature of about −60° C.

The flawless bending at 180° C. of the steel sheet is limited to inside bending diameters larger than 2.5 times the thickness of the sheet in the rolling direction and larger than 3 times the thickness of the sheet in the direction transverse to the rolling.

In another example, in a product such as a microalloyed steel sheet has a yield point higher than 700 MPa and may be bent at 180° without producing a flaw at a bending diameter less than twice the thickness of the sheet, but this steel has the drawback of having a ductile/brittle transition temperature between −20° C. and −40° C.

OBJECTS OF THE INVENTION

An object of the invention is to provide a process for producing a strip of hot rolled steel sheet having a very high yield point of use in particular for the forming of parts and being capable of being subjected to a flawless 180° bending at a bending diameter less than twice the thickness of the sheet and presenting a brittle/ductile transition at a temperature below −50° C.

DETAILED DESCRIPTION OF THE INVENTION

Figure 1:
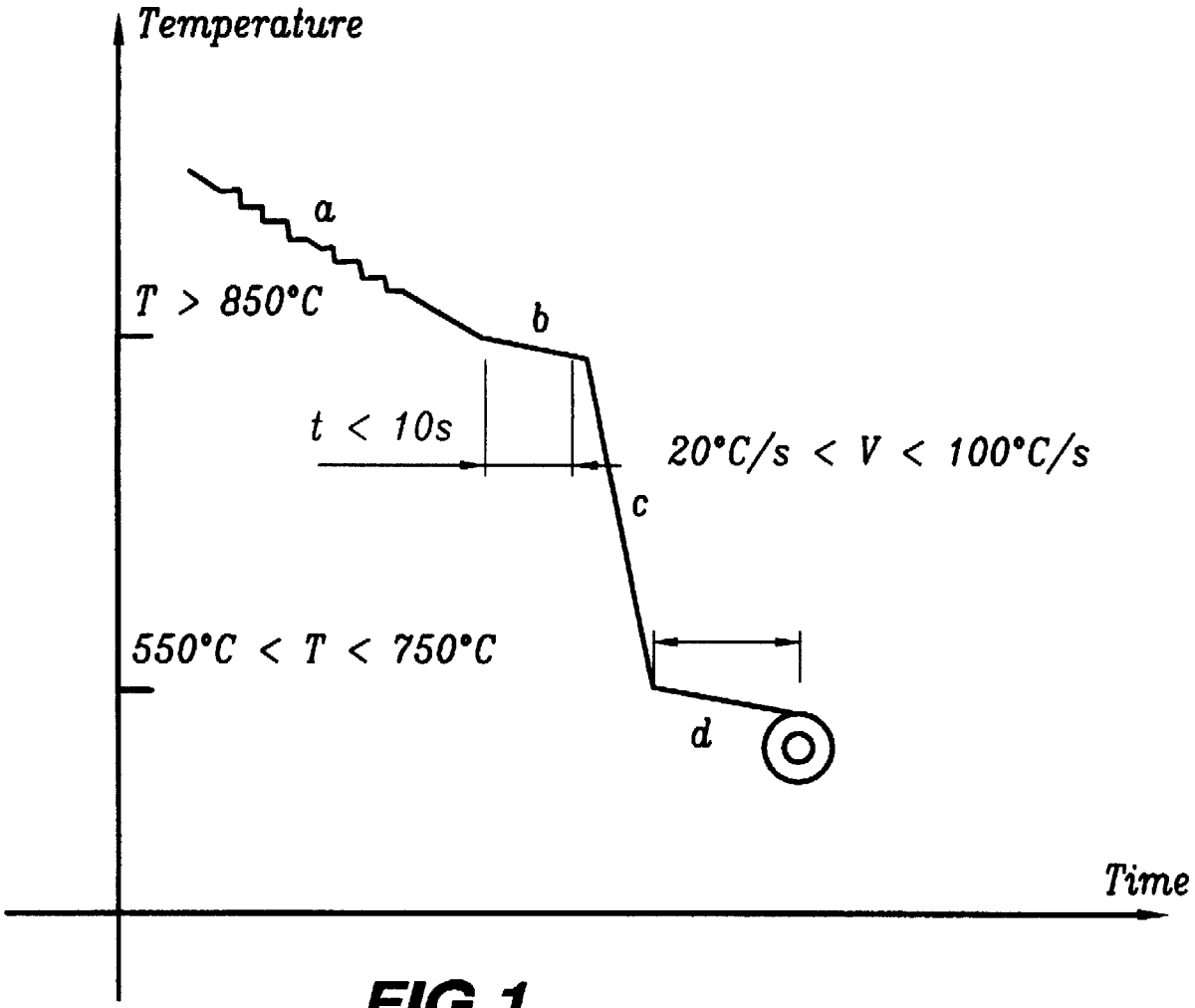
FIG. 1 shows the variation in temperature as a function of time on a steel sheet according to the invention.

The invention provides a process for producing a strip of hot rolled steel sheet having a very high yield point of use in particular for the forming of parts and presenting a brittle/ductile transition at a temperature below −50° C., characterized in that the steel which has the following composition by weight:

carbon≦0.1%,

1%≦manganese≦1.5%, silicon≦0.3%, phosphorus≦0.03%, sulphur≦0.01%, 0.01%≦aluminium≦0.1%, 0.04%≦niobium≦0.06%, 0.1%≦titanium≦0.15%, 0.1%≦molybdenum≦0.2%, is subjected, after hot rolling, to a controlled cooling at a cooling rate of between 20° C. per second and 100° C. per second down to a temperature of between 550° C. and 750° C. of the end of the cooling.

Further features of the invention are the following;

the temperature of the end of the hot rolling is preferably higher than 850° C. or even 900° C.;

the interval of time between the end of the hot rolling and the beginning of the controlled cooling is preferably less than 10 seconds and for example of the order of 1.5 seconds.

The invention also provides a steel sheet characterized in that the composition of the steel by weight is the following:

carbon≦0.1%,

1%≦manganese≦1.5%, silicon≦0.3%, phosphorus≦0.03%, sulphur≦0.01%, 0.01%≦aluminium≦0.1%, 0.04%≦niobium≦0.06%, 0.1%≦titanium≦0.15%, 0.1%≦molybdenum≦0.2%, and the sheet is subjected, after hot rolling, to a controlled cooling from a temperature preferably higher than 850° C. or even 900° C. at a cooling rate of between 20°C. per second and 100° C. per second down to a temperature of between 550° C. and 750° C. of the end of the cooling, the interval of time between the end of the hot rolling and the beginning of the cooling being preferably less than 10 seconds.

The following description and the accompanying Figures given by way of a nonlimitative example, will explain the invention.

In the drawings:

FIG. 1 represents a curve showing diagrammatically according to the process of the invention the variation in temperature as a function of time, imposed on the strip of hot rolled steel sheet.

Figure 2:
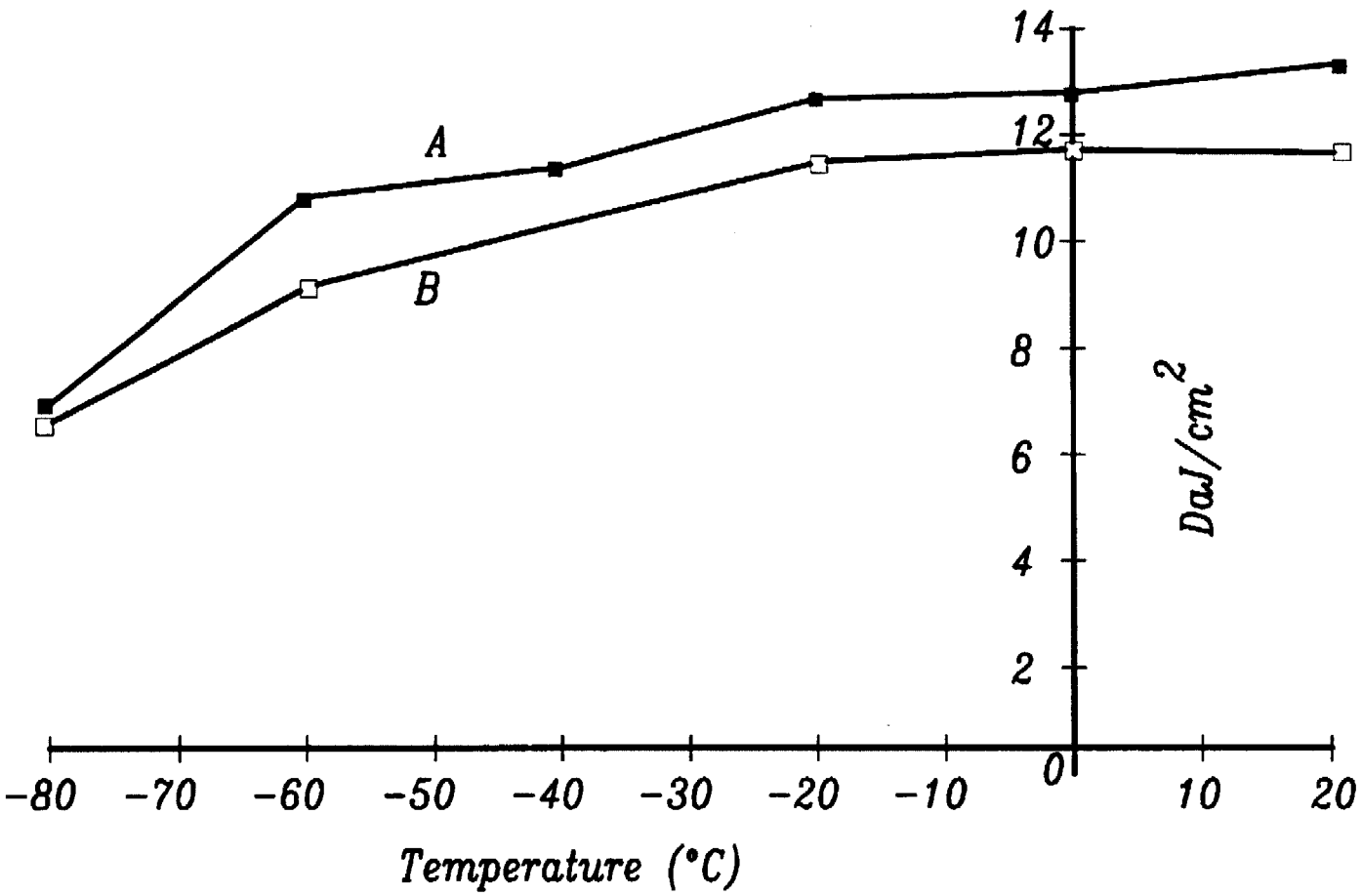
FIG. 2 shows two brittle-ductile transition curves.

FIG. 2 represents brittle/ductile transition curves for a steel sheet 5 mm thick, the brittle/ductile transition being measured in the longitudinal direction and in the transverse direction of the strip of hot rolled sheet.

The process according to the invention concerns the production of a strip of hot rolled steel sheet having a very high yield point of use in particular for the forming of parts and presenting a brittle/ductile transition at low temperature. In the example of application of the invention, the steel base has the following composition by weight:

0.06% carbon≦0.08%, 1.4%≦manganese≦1.5%, 0.02% silicon≦0.26%, phosphorus≦0.02%, sulphur≦0.005%, 0.02%≦aluminium≦0.06%, 0.055%≦niobium≦0.06%, 0.110%≦titanium≦0.14%, 0.130%≦molybdenum≦0.170%.

The base composition permits obtaining a microstructure of ferrite and granular bainite hardened by the precipitation of niobium-titanium microalloy elements.

The rolling process according to the invention aims to obtain a good recrystallization of the austenitic grains at the outlet of the rolling mill stands thereby providing an equiaxial structure.

The structure of the steel of the strip of sheet permits obtaining high elongations which are higher than 15% and may reach 20%, and flawless bends at 180° C. with inside bending diameters less than twice the thickness of the sheet.

In the process, the temperature at the end of the rolling is higher than 850° C., and preferably 900° C., so as to, on one hand, limit the precipitation of the microalloy elements produced by the hot rolling and, on the other hand, benefit as far as possible from their hardening effect during the controlled cooling.

The controlled cooling is imposed on the strip of hot rolled sheet after an interval of time of less than 10 seconds between the end of the hot rolling and the beginning of the controlled cooling.

Preferably, the interval of time is of the order of 1.5 seconds, which ensures a very fine grain size and a high yield point.

The controlled cooling rates are chosen between 20 C. per second and 100° C. per second, depending on the thickness of the strip of sheet to be treated. For example, the controlled cooling rate is on average 40° C. per second for a strip of sheet about 5 mm thick. Under these conditions, there is a hardening precipitation of the microalloy elements which permits obtaining a yield point of higher than 700 MPa, namely 740 MPa.

The temperature of the end of the controlled cooling is between 550° C. and 750° C. and preferably 650° C., which ensures a hardening precipitation of the microalloy elements.

FIG. 1 is a curve diagrammatically representing, according to the process of the invention, the variation in temperature as a function of time imposed on the strip of steel sheet after hot rolling. After rolling at a temperature higher than 850° C. represented by the curve portion "a", a period of less than 10 seconds, represented by the curve portion "b", is required before the controlled cooling of the strip of hot rolled sheet which is represented by the curve portion "c".

When the strip of sheet reaches the temperature of 550° to 750° C. of the end of the cooling, it is wound into a coil as shown diagrammatically at "d" in the Figure.

FIG. 2 shows two brittle/ductile transition curves A and B, i.e. curves indicating the energy of the rupture of a test specimen taken from a sheet, as a function of the temperature. The curves A and B relate to a steel sheet 5 mm thick and the brittle/ductile transition is measured respectively in the longitudinal direction and in the transverse direction of the hot rolled sheet. The strip of steel sheet according to the invention does not have a brittle/ductile transition in the temperature range between +20° C. and −80° C. All the ruptures are therefore ductile down to −80° C.

The brittle/ductile transition temperature is therefore lower than −80° C.

The process according to the invention permits producing a hot rolled steel sheet having a thickness of between 2.5 and 10 mm, the steel of which has a yield point higher than 700 MPa. The steel sheet may be subjected to a flawless bending at 180°, the inside bending diameter of which may be less than twice the thickness of the sheet.

The low equivalent carbon content of 0.4% and the low manganese content impart an excellent weldability to the steel.

The titanium participates in the hardening by precipitation in the form of TiC.

The molybdenum permits, after precipitation of the microalloy elements in the form of carbide, limiting the diffusion of carbon at high temperature, thereby resulting in fine precipitates in the ferritic matrix and the lowering of the brittle/ductile transition temperature to a temperature always below −50°C. in the case of a steel having the composition defined by the invention.

The strip of hot rolled sheet according to the invention may be used for manufacturing bent parts, section members, or press-formed thin and therefore lighter parts and/or parts having improved mechanical characteristics as concerns fatigue. The low fragile/ductile transition temperature allows operation of parts of equipment employed for example in the construction of cranes, in a very low temperature range with no risk of a brittle fracture.

What is claimed is:

1. Process for producing a strip of hot rolled steel sheet having a thickness of from 2.5 to 10 mm and a yield point above 700 MPa and presenting a brittle/ductile transition at a temperature below −50° C., said steel having the following composition by weight:

carbon≦0.1%,

1%≦manganese≦1.5%, silicon≦0.3%, phosphorous≦0.03%, sulphur≦0.01%, 0.01%≦aluminum≦0.1%, 0.04%≦niobium≦0.06%, 0.1%≦titanium≦0.15%, 0.1%≦molybdenum≦0.2%, said process comprising the following steps:

hot rolling said steel, subjecting the hot rolled steel to a controlled cooling at a cooling rate of between 20° C. per second and 100° C. per second down to a temperature of between 550° C. and 750° C.

2. Process according to claim 1, wherein said temperature at said end of said hot rolling is higher than 850° C.

3. Process according to claim 1, wherein there is an interval of time of less than 10 seconds between said end of said hot rolling and said beginning of said controlled cooling.

4. Process according to claim 2, wherein there is an interval of time of less than 10 seconds between said end of said hot rolling and said beginning of said controlled cooling.

5. A hot rolled steel sheet having a very high yield point and presenting a brittle/ductile transition at a temperature below −50° C., the composition of said steel by weight being the following;

carbon≦0.1%,

1%≦manganese≦1.5%, silicon≦0.3%, phosphorus≦0.03%, sulphur≦0.01%, 0.01%≦aluminium≦0.1%, 0.04%≦niobium≦0.06%, 0.1%≦titanium≦0.15%, 0.1%≦molybdenum≦0.2%, said sheet having been subjected, after said hot rolling, to a controlled cooling from a temperature higher than 850° C. at a cooling rate of between 20° C. per second and 100° C. per second down to a temperature of between 550° C. and 750° C., there being a short interval of time between the end of said hot rolling and the beginning of said cooling.

6. A hot rolled steel sheet according to claim 5, wherein said controlled cooling is effected from a temperature of 900° C.

7. A hot rolled steel sheet according to claim 5, wherein said interval of time is less than 10 seconds.

8. A hot rolled steel sheet according to claim 6, wherein said interval of time is less than 10 seconds.

9. A hot rolled steel sheet according to claim 5, wherein the thickness of the sheet is from 2.5–10 mm and the sheet has a yield point above 700 MPa.

10. A hot rolled steel sheet according to claim 6, wherein the thickness of the sheet is from 2.5–10 mm and the sheet has a yield point above 700 MPa.

11. A hot rolled steel sheet according to claim 7, wherein the thickness of the sheet is from 2.5–10 mm and the sheet has a yield point above 700 MPa.

12. A hot rolled steel sheet according to claim 8, wherein the thickness of the sheet is from 2.5–10 mm and the sheet has a yield point above 700 MPa.

* * * * *